United States Patent [19]

McCarthy

[11] 4,058,317

[45] Nov. 15, 1977

[54] APPARATUS FOR PLAYING A BOARD GAME

[76] Inventor: John Brian McCarthy, 13 Coolnevaun, Kilmacud, Dublin, Ireland

[21] Appl. No.: 698,322

[22] Filed: June 22, 1976

[30] Foreign Application Priority Data

June 23, 1975 United Kingdom ..... 26575/75

[51] Int. Cl.[2] ..... A63F 3/00

[52] U.S. Cl. ..... 273/130 R; 273/136 E; 273/153 R

[58] Field of Search ..... 273/130 R, 135 R, 136 C, 273/136 E, 136 F, 137 AC, 137 AD, 153 R; 35/10, 13; 46/17, 23

[56] References Cited

U.S. PATENT DOCUMENTS

| | | | |
|---|---|---|---|
| 911,461 | 2/1909 | Trout | 273/153 R |
| 2,095,046 | 10/1937 | Wilner | 273/153 R |
| 2,198,444 | 4/1940 | Swanson | 273/153 R |
| 2,470,246 | 5/1949 | Heisman | 35/13 |
| 3,193,293 | 7/1965 | Schaper | 273/136 C |
| 3,417,996 | 12/1968 | Janiszewski | 35/13 |

FOREIGN PATENT DOCUMENTS

| | | | |
|---|---|---|---|
| 637,567 | 5/1950 | United Kingdom | 35/13 |

*Primary Examiner*—Richard C. Pinkham
*Assistant Examiner*—Harry G. Strappello
*Attorney, Agent, or Firm*—Duffield & Lehrer

[57] ABSTRACT

The present invention provides the apparatus for playing a board game. There is provided a base plate with rows of equally spaced apart studs upon which may be mounted for rotational movement counters in the shape of gear wheels, the spacing between the studs and the diameter of the gear wheel shaped counters being such that counters mounted on immediately adjacent studs mesh with one another whereby rotation of one counter on its stud causes rotation of meshing counters on their respective studs.

13 Claims, 5 Drawing Figures

APPARATUS FOR PLAYING A BOARD GAME

The present invention relates to apparatus for playing a game of the kind comprising a board and a plurality of counters which are moved on the board to achieve a desired result in accordance with the rules of the game.

According to the present invention there is provided an apparatus for playing a board game, comprising a plurality of counters and a base plate having a regular array of locating means for the counters, each counter when positioned on the base plate at a locating means being substantially prevented from lateral movement but being capable of rotation about an axis perpendicular to the base plate, and each counter when positioned at a locating means being in driving engagement with any counter positioned at an adjacent locating means.

An embodiment of the invention comprises a base plate having a plurality of studs thereon. A counter in the form of a gear wheel may be inserted in rotatable position on each stud and the studs are so positioned that a gear wheel counter placed on a particular stud is in meshing connection with the gear wheel on any adjacent stud. Each gear wheel counter has a center hole of sufficient diameter to enable the gear wheel counter to rotate freely on the studs.

An even number of gear wheel counters are used and the counters are divided into two sets or teams, each with a distinguishing colour. Each team comprises master gear wheel, which is marked with an arrow to indicate the direction which this master gear may be turned in accordance with the rules of the game.

A game may comprise, for example, six rows of studs with eight studs in each row. Eight gear counters may comprise one team. Each team of eight is placed in a straight row farthest removed from each other. The counters in one team may be coloured white and the counters in the other team may be coloured black. A player may move only one counter for his turn and he may move it in a vertical, horizontal or diagonal direction.

At any stage in the game, a player may on completion of his move, elect to turn his master gear. If this in turn operates to turn the master gear counter of the opponent in the direction of the arrow on the opponent's master gear counter, he wins the game. If on the other hand, having elected to operate his master gear counter, this counter does not turn the opponent's master gear counter, or turns it in the direction opposite to the arrow, he loses the game.

The invention will be better understood with reference to the embodiments thereof shown in the accompanying drawings, in which.

Figure 2:
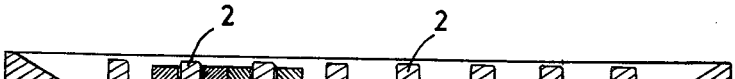
FIG. 2 is a cross section through the line X—X on FIG. 1.
Figure 1:
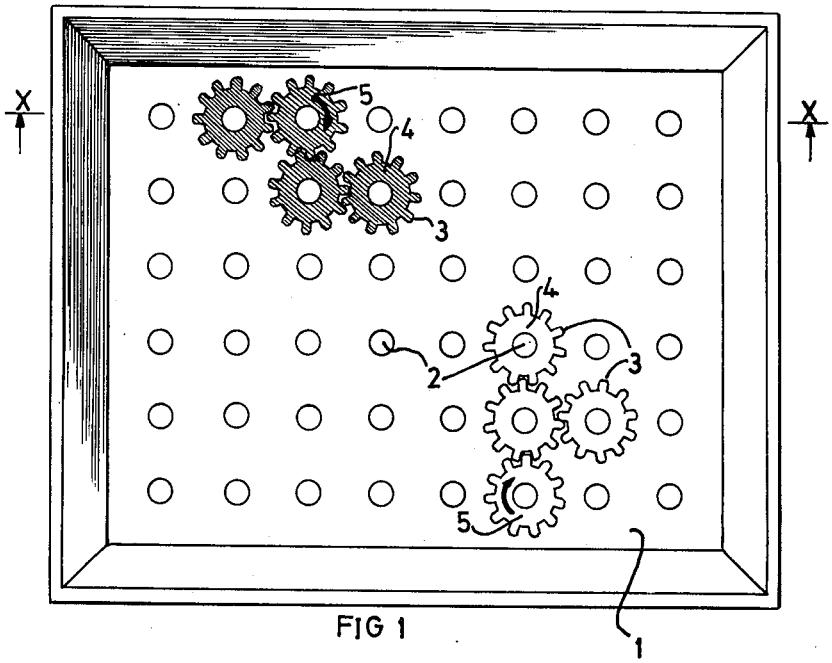
FIG. 1 is a plan view of the board game with a number of counters in position.
Figure 3:
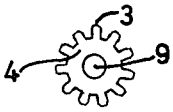
FIG. 3 is a plan view of one of the counters.

In the drawings 1 is a base plate, of any suitable material, on which are inserted a plurality of counter locating means in the form of studs 2. The studs are arranged in a rectangular array of rows and columns and are positioned so that the teeth 3 of a gear wheel counter 4 located on a stud can engage the teeth of any adjacent gear wheel counter. Each gear wheel counter 4 is provided with a centre hole 9 of sufficient diameter to enable the gear wheel counter 4 to rotate freely on stud 2 about the axis of the stud, which axis is substantially perpendicular to the base plate 1. The diameter of the hole 9 is, however, insufficient to allow significant lateral movement of the counter. The counters are divided into two teams of equal number and each team has a distinguishing colour. In each team there is also a master gear wheel counter 5 marked with an arrow as shown in FIG. 1. The arrow indicates the direction in which the master gear wheel counter may be turned in accordance with the rules of the game.

Figure 5:
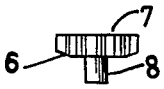
FIG. 5 is a side view of an alternative form of counter.

In a further embodiment of the invention, the studs may be formed integrally with the gear wheel counter. This is shown in FIG. 5 where the stud 8 forms part of the gear wheel 7. In this embodiment the base plate is formed with a plurality of holes of sufficient diameter to enable the studs 8 to rotate freely therein.

Figure 4:
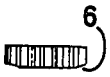
FIG. 4 is a side view of one of the counters.

To enable the gear wheel counters 4 or the gear wheel counters 7 to rotate freely, the underside of the gear wheel counter is bevelled around its periphery as shown at 6 in FIGS. 4 and 5.

It is also apparent that the counters 4 and 7 may be turned by friction means instead of the geared drive as stated above.

I claim:

1. An apparatus for playing a board game by a plurality of players, said apparatus comprising a plurality of counters divided into a plurality of sets each having a visible distinguishing characteristic, there being one set for each active player, a base plate having a regular array of counter locating means each defining a respective position on said base plate where a counter may be placed during play, and means provided in respect of each counter for cooperation with a locating means when the counter is positioned on the base plate whereby the counter is substantially prevented from lateral movement but capable of rotation about an axis perpendicular to the base plate, one counter of each set being provided with an indication of a particular direction of rotation for that counter, each counter when positioned at any locating means being in driving engagement with any counter positioned at an adjacent locating means, said base plate being of sufficient size and containing a sufficient number of counter locating means for the initial mounting of a plurality of counters of each active set without interfering with counters of another set.

2. An apparatus according to claim 1, in which each counter is in the form of a gear wheel.

3. An apparatus according to claim 2, in which the locating means are studs on the base plate, and the cooperating means of each counter is a central hole in the counter.

4. An apparatus according to claim 2, in which the locating means are holes in the base plate, and the cooperating means of each counter is a central stud on the counter.

5. An apparatus according to claim 2, in which the locating means are arranged in a rectangular array of rows and columns.

6. An apparatus according to claim 2, in which the underside of each counter is bevelled around its periphery.

7. An apparatus according to claim 1 in which only one counter of each set is provided with an indication of a particular direction of rotation for that counter.

8. An apparatus for playing a board game, said apparatus comprising at least two sets wherein one of said sets is distinguishable from another of said sets, each set having a plurality of counters each capable of rotatable positioning upon a base plate, said base plate having a regular of positioning means for rotatably receiving said counters said positioning means being spaced equally, each counter having surface means for providing driving engagement with any of said counters positioned adjacent thereof, and each set including a master counter, each master counter having means for indicating the required direction of rotation of said master counter in a selected clockwise and counter-clockwise direction.

9. An apparatus as defined in claim 8 wherein each set includes only one master counter.

10. An apparatus as defined in claim 8 wherein said counters are wheels and said surface means is of a gear-toothed configuration.

11. A new article of manufacture comprising an apparatus for competitively playing a board game, said apparatus including a base plate and a plurality of gear wheels, all of said gear wheels being of substantially the same size and configuration, said plurality of gear wheels having identifying means dividing said gear wheels into at least two sets with one of said sets being distinguishable from another of said sets, each set of gear wheels including an equal number of a plurality of gear wheels each capable of rotatable positioning upon said base plate, said base plate having a substantially regular rectangular array of rows and columns of positioning means for rotatably mounting said gear wheels, said positioning means being greater in number than the total number of said gear wheels and being equally spaced in said rows and columns, the size of each gear wheel and the arrangement and spacing of said positioning means being such that each gear wheel is in driving engagement with any other of said gear wheels positioned adjacent thereof in the same row or column, and each set of gear wheels including a master gear wheel having means visible from the top thereof for indicating the required direction of rotation of said master gear wheel in a preselected clockwise or counter-clockwise direction.

12. An apparatus as claimed in claim 11 wherein each of said sets of gear wheels includes eight gear wheels, said positioning means are studs and each gear wheel has a base for receiving one of said studs, and said regular rectangular array of positioning means includes at least six rows and eight columns of said studs.

13. An apparatus as claimed in claim 11 wherein each set includes only one master gear wheel.

* * * * *

UNITED STATES PATENT OFFICE

CERTIFICATE OF CORRECTION

Patent No. 4,058,317 Dated November 15, 1977

Inventor(s) John Brian McCarthy

It is certified that error appears in the above-identified patent and that said Letters Patent are hereby corrected as shown below:

Column 1, line 29 after "comprises" read --a--.

Column 3, line 6 after "regular" read --array--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*